United States Patent [19]

Maurer

[11] 4,313,552

[45] * Feb. 2, 1982

[54] APPARATUS FOR DRIVING FASTENERS

[75] Inventor: Werner Maurer, Zizishausen, Fed. Rep. of Germany

[73] Assignee: Firma Karl M. Reich Maschinenfabrik GmbH, Nuertingen, Fed. Rep. of Germany

[ * ] Notice: The portion of the term of this patent subsequent to Jun. 2, 1998, has been disclaimed.

[21] Appl. No.: 144,950

[22] Filed: Apr. 29, 1980

Related U.S. Application Data

[63] Continuation-in-part of Ser. No. 68,746, Aug. 23, 1979.

[30] Foreign Application Priority Data

Sep. 1, 1978 [DE] Fed. Rep. of Germany ..... 2838194
May 19, 1979 [DE] Fed. Rep. of Germany ..... 2920342

[51] Int. Cl.[3] ..... B25C 1/04

[52] U.S. Cl. ..... 227/109; 227/112; 227/116; 227/130

[58] Field of Search ..... 227/112, 113, 114, 115, 227/116, 120, 130, 109

[56] References Cited

U.S. PATENT DOCUMENTS

| | | | |
|---|---|---|---|
| 2,801,415 | 8/1957 | Jenny | 227/130 |
| 3,087,160 | 4/1963 | Doppelt | 227/113 |
| 3,099,837 | 8/1963 | Heilman et al. | 227/130 |
| 3,104,395 | 9/1963 | Grey, Jr. et al. | 227/115 |
| 3,232,511 | 2/1966 | Crooks | 227/130 |
| 3,245,596 | 4/1966 | Lygo | 227/116 |
| 3,353,737 | 11/1967 | Howard et al. | 227/136 |
| 3,820,705 | 6/1974 | Beals | 227/113 |
| 3,969,988 | 7/1976 | Maurer | 227/130 |

FOREIGN PATENT DOCUMENTS

| | | | |
|---|---|---|---|
| 2148396 | 4/1973 | Fed. Rep. of Germany | 227/112 |
| 419372 | 9/1974 | U.S.S.R. | 227/113 |

*Primary Examiner*—John McQuade
*Attorney, Agent, or Firm*—W. G. Fasse; D. F. Gould

[57] ABSTRACT

The present driver for fasteners such as nails, screws and the like is provided with a separator member operatively located between the ejector channel and a fastener supply magazine. The separator member takes up a fastener arresting position in which the separator member reaches between the shafts of two fasteners and a retracted position in which the separator member releases a fastener for movement into the ejector channel. The separator member cooperates with a holding device which holds a fastener in the ejector channel after release by the separator member and prior to the driving stroke. The holding device may comprise two permanent magnets. The separator member has a tip which reaches into the ejector channel to different extents depending on the adjustment of an adjusting device for the separator member.

6 Claims, 6 Drawing Figures

APPARATUS FOR DRIVING FASTENERS

CROSS-REFERENCE TO RELATED APPLICATION

The present application is a continuation-in-part application of my copending application Ser. No. 68,746; filed on Aug. 23, 1979 now in condition for allowance.

BACKGROUND OF THE INVENTION

The present invention relates to an apparatus for driving fasteners having a shaft such as nails, screws, and the like.

Driving devices of this type are used for driving loose fasteners such as nails, screws, brads, etc., which are made ready in a magazine connected to the driving apparatus. It is known from the parent specification (U.S. Ser. No. 68,746) to provide a separating member in the vicinity of the ejector channel, which separating member reaches between the shafts of the first and the second fastener, and then releases the second fastener after the first fastener has been driven, so that the second fastener may advance into the ejector channel.

The heads of the fasteners may, however, have different diameters, so that the spacing of the shafts may vary. It may occur in the worst instance that the separating member strikes a shaft of a fastener.

OBJECTS OF THE INVENTION

In view of the foregoing it is the aim of the invention to achieve the following objects singly or in combination:

- to produce a separator member which allows a sure separating of the fasteners, even if they have different head diameters;
- to adjust and lock the separator member in several positions so that the tip of the separator member reaches into the ejector channel to different extents depending on the adjusted position; and
- to modify the driver of the parent disclosure without departing from the basic structure of the parent disclosure.

SUMMARY OF THE INVENTION

According to the invention the fastener separator member of the driving apparatus is provided with adjusting means for normally adjusting the position of the separator member so that the tip of the separator member may accommodate fasteners having different head diameters.

The location of the separator member in its disengaged position, according to the feature of the invention, offers additionally the possibility to also use fasteners with the driving apparatus which are connected into fastener strips such as, for example, nail strips or screw strips.

Consequently, the driving apparatus according to the invention may be used not only for loose fasteners with varying head diameters, but also for fasteners connected into fastener strips.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
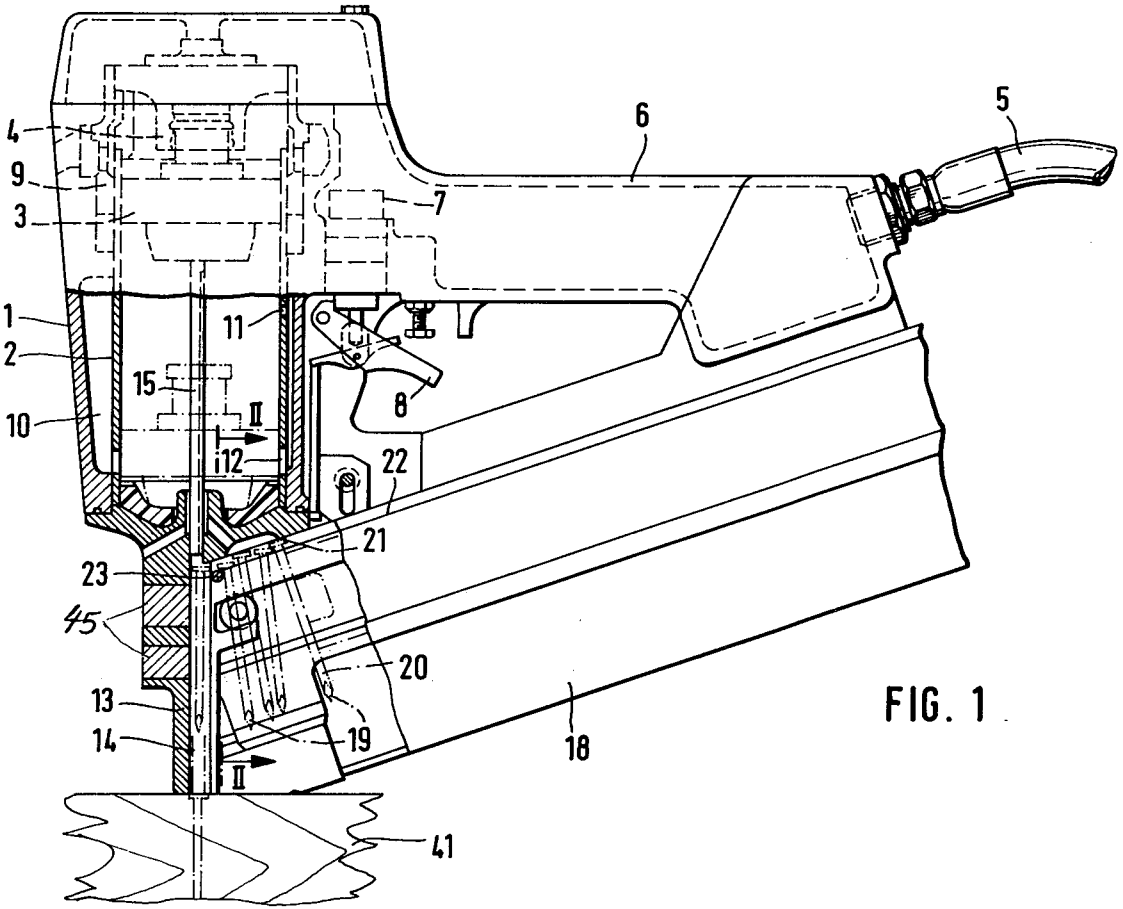
FIG. 1 shows a side view, partially in section, of a driving apparatus according to the invention.

FIG. 1 shows a cylinder 2 arranged in a housing 1. An impact piston 3 is slidably supported in the cylinder 2. The piston 3 may be driven by compressed air. The impact piston 3 is held in its rest position, as indicated in FIG. 1 with dashed lines, by means of a rubber elastic latching device 4 as, for example, disclosed in U.S. Pat. No. 3,969,988. A connecting hose 5 as well as the hollow hand grip 6 of the housing 1 serve to supply the pressurized air from a source which is not illustrated.

A triggering valve 7 may be activated only when both the triggering lever 8 and a work piece gauging device have moved from their rest position to their working position. A slide valve 9 arranged concentric to the cylinder 2 is controlled in the usual manner by means of the triggering valve 7, so that the pressurized air may enter into the cylinder 2 above the impact piston 3, thus moving the impact piston 3 to its working position, as illustrated with dash-dotted lines, and that the compressed air in the cylinder chamber is subsequently vented again.

An air reservoir 10 surrounding the cylinder 2 is provided for the return stroke of the impact piston 3. The air reservoir 10 is filled with compressed air through the bore 11 in the cylinder 2 during the working stroke. The compressed air flows into the space beneath the impact piston 3 through the bore 12 after the air has been vented from the cylinder chamber above the impact piston 3, thus moving the impact piston 3 back to its rest position.

A cylinder foot 13 is connected to the housing 1 by means of screws. The cylinder foot 13 has an ejector channel 14. A driving ram 15 connected to the impact piston 3 is movably supported in the channel 14.

Figure 4:
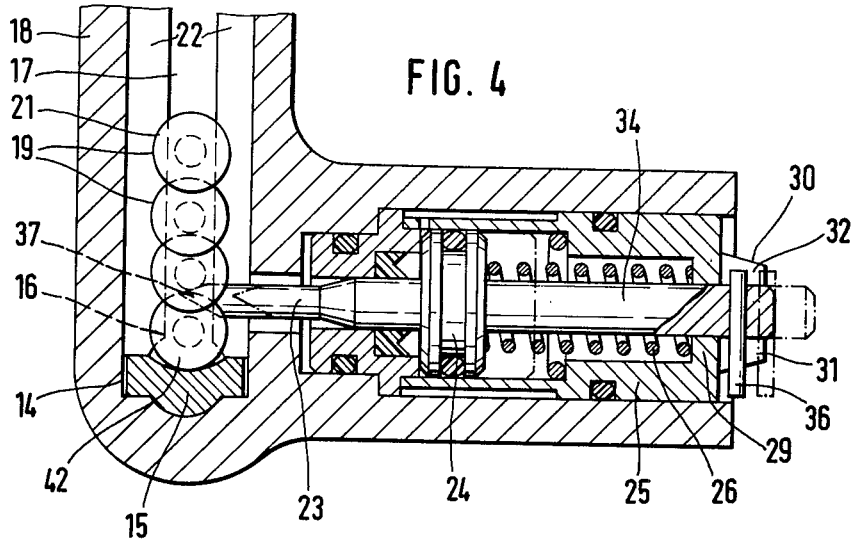
FIG. 4 shows a section along the line IV—IV in FIG. 2.

FIG. 4 also illustrates how the ejector channel 14 is connected to a guide slot 16. A guide chute 17 of a magazine 18 connected to the cylinder foot 13 and the hand grip 6 empties into the guide slot 16. The central plane of this guide chute 17 extends through the longitudinal axis of the ejector channel 14.

Loose nails 19 are held ready in the magazine 18. The shafts 20 of the loose nails 19 are guided in the guide chute 17 and their heads 21 rest on two adjacent support surfaces 22 which are inclined toward the longitudinal axis of the ejector channel 14. The guide chute 17 is open at the rear.

Figure 2:
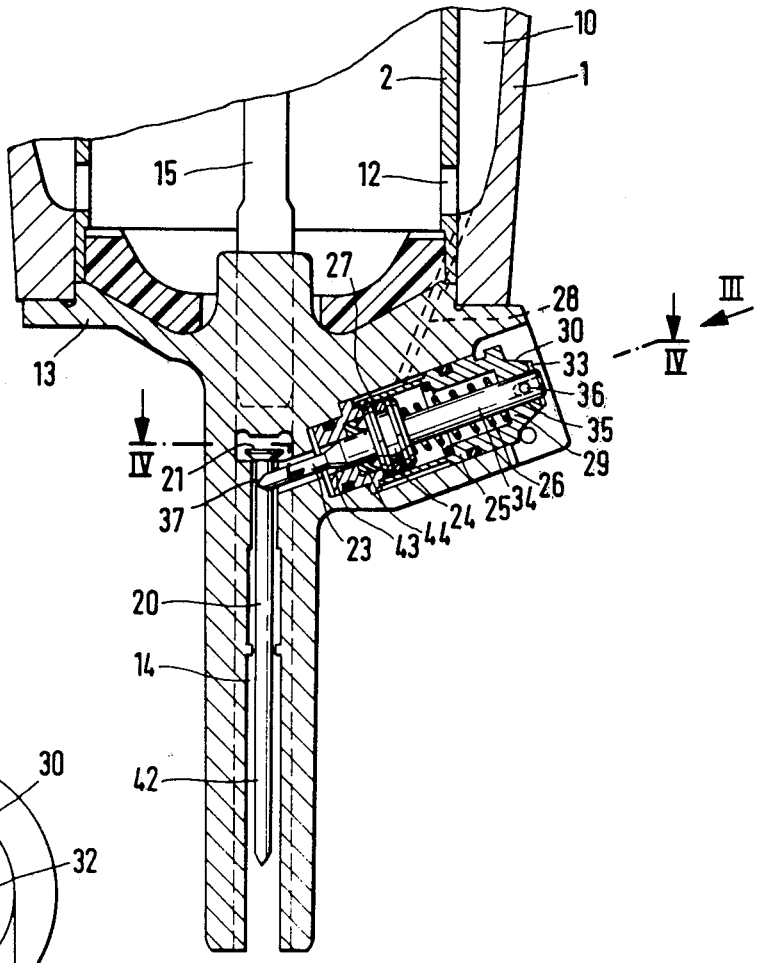
FIG. 2 shows a section along line II—II in FIG. 1.

FIGS. 2 and 4 show a separator member 23 having a pointed tip. The separator member 23 shown in FIGS. 2 and 4 in the blocking position, extends into the guide slot 16 so that it separates the ejector channel 14 from the guide chute 17. The separator member 23 is connected with a separating piston 24 which is movably supported in a separating cylinder or chamber 25 and is pressed into its blocking position by means of a compression spring 26. FIG. 2 illustrates by dotted lines how the cylinder chamber 27 may be connected to the air reservoir 10 by means of a connecting bore 28.

Figure 3:
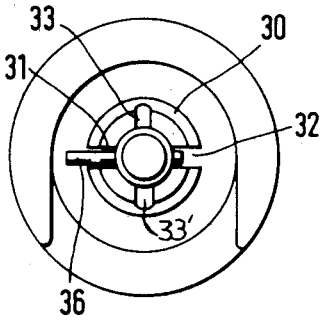
FIG. 3 shows a view looking in the direction of the arrow III in FIG. 2.

The separating cylinder or chamber 25 forms a sleeve which is open at the front, toward the channel 14. The rear end of this sleeve has an end wall 29 with a conical projection 30. Two relatively deep grooves 31 and 32 and a shallow groove 33 extending perpendicularly to the grooves 31 and 32, have been machined in the conical projection 30. A fourth groove 33' may also be provided as seen in FIG. 3. Each groove may have a different depth relative to any one of the other grooves in the projection 30.

A guide rod 34 connected to the separating piston 24 is guided by the conical projection 30 in a bore 35. The end of the guide rod 34 is provided with a guide pin 36 which engages in the groove 31 in the position illustrated in FIGS. 2 and 4.

The end of the separator member 23 is bevelled or wedge-shaped, so that a separating tip 37 is formed, which is arranged offset with reference to the longitudinal axis of the separator member 23.

Figure 5:
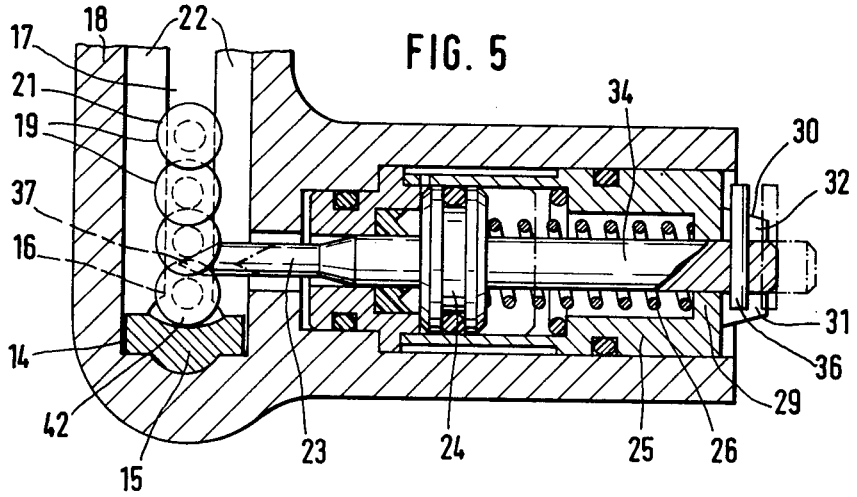
FIG. 5 shows a section also along line IV—IV in FIG. 2, however, with the separator member rotated 180° relative to FIG. 4.
Figure 6:
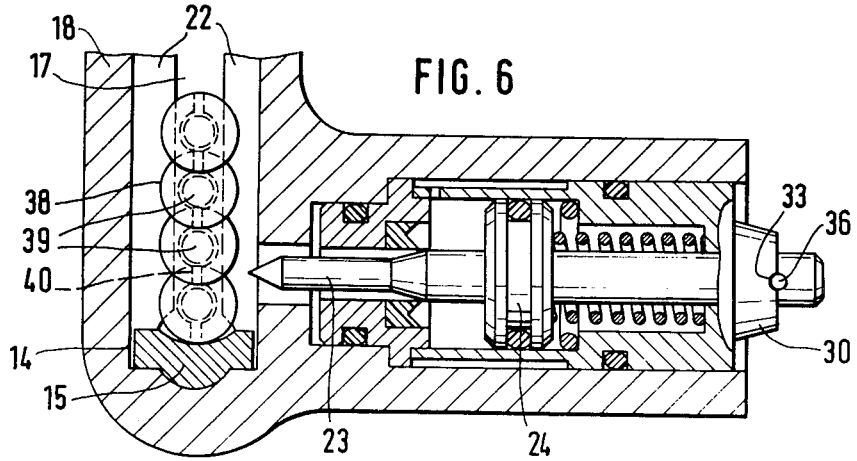
FIG. 6 shows a section also along line IV—IV in FIG. 2, but with the separator member rotated 90° relative to FIG. 4.

The separating tip 37 also has a definite spacing from the center of the ejector channel 14, which spacing becomes smaller, when the separator member 23 is rotated 180° (as shown in FIG. 5), so that the guide pin 36 engages in the groove 32. If the separator member 23 is rotated 90° (as shown in FIG. 6), and if the guide pin 36 engages in the shallow groove 33, then the separator member 23 remains in its releasing position during the entire nailing process, whereby fasteners secured in fastener strips 38 may be driven. The fasteners 39 may be connected to one another by means of a synthetic band 40 to form the strip 38.

In order to operate the driving apparatus according to the invention, first the rear, open end of the guide chute 17 of the driving apparatus magazine 18 is coupled to a dispensing device not shown. The nails have been sorted in this dispensing device and are hanging by their heads ready for delivery. Nails with twisted shafts, screw nails, nail screws, screws, or the like may, of course, also be used in place of nails having a smooth shaft. After the driving apparatus has taken from the dispensing device, the nails 19, hanging by the heads 21, slide in the guide chute 17 due to gravity as far as the separator member 23 and are then pressed by means of a spring loaded magazine slider, which is not shown, in the direction of the ejector channel 14 until they rest against the separator member 23.

The driving apparatus is connected by means of the connecting hose 5 to a compressed air source not shown. If the driving apparatus is now pressed against a work piece 41 (FIG. 1), then the impact stroke of the impact piston 3 is triggered in the usual manner after activation of the triggering lever 8. However, the impact piston 3 advances to its working position, as shown in FIG. 4, without driving a nail, since there is still no nail in the ejector channel 14. However, compressed air also reaches air reservoir 10 in this position of the impact piston 3 through the bore 11 in the cylinder 2, and further through the bore 28 into the separating cylinder or chamber 25, thereby pushing the separating piston 24 together with the separator member 23 against the effect of the compression spring 26 outwardly into the position illustrated by the dash-dotted lines. The separator member 23 now opens the guide slot 16, which already has nails 19 in it. The first nail 42 of these nails 19 is pushed in the direction of the ejector channel 14 until its head 21 strikes against the driving ram 15.

If the triggering lever 8 is now released, then the inner chamber of the cylinder 2 is cut-off from the compressed air supply in the usual manner and vented at the same time. The compressed air stored in the air reservoir 10 may thus advance the impact piston 3 to its return rest position, where it is held fast by means of the latching device 4. During this reverse stroke movement, the driving ram 15, by means of friction and with the help of cross grooves in the driving ram 15, acts upon the head of the first nail 42, so that the shaft 20 of this first nail 42 swings clockwise until it rests against the wall of the ejector channel 14 opposite the guide slot 16. It is held there by means of a holding device such as permanent magnets 45. If the next blow is now triggered as previously described, then the driving ram 15 drives the nail 42 into the work piece 41. The compressed air from the air reservoir 10 again pushes the separator member 23, so that the next nail is pressed against the driving ram 15 which is in the driving position. After the return stroke of the driving ram, this next nail moves into the ejector channel 14 and the driving apparatus is ready for the next blow.

It is important for the trouble free functioning of the separator member 23 according to the invention, that this separating member 23 extends between the shafts 20 of the two following nails 19 after the driving of the first nail 42 and as long as the driving ram 15 is still in the driving position. That is, after the triggering lever 8 has been released, the separator member 23 must reach its blocking position before the driving ram 15 returns to its rest position. This may be accomplished by means of the appropriate dimensioning of the compression spring 26 and by means of a conical taper 43 toward the separator member 23. The taper 43 withdraws from the seal 44 during the releasing position of the separating piston 24 and allows a partially throttled venting of the cylinder chamber 27, so that the separating piston 24 returns without delay to its blocking position after the releasing of the triggering lever 8.

Although the invention has been described with reference to specific example embodiments, it is to be understood that it is intended to cover all modifications and equivalents within the scope of the appended claims.

What is claimed is:

1. A driving apparatus for driving fasteners having shafts into a work piece, said apparatus being able to receive fasteners loosely slidable relative to each other in a row in the guide channel of a magazine, comprising housing means, fastener driving means in said housing means, said fastener driving means comprising driving rod means and ejector channel means, said driving rod means being movable in said ejector channel means between a rest position and a driving position, said apparatus further comprising magazine and guide channel means operatively connectable to said housing means for supplying fasteners loosely slidable in a row from said magazine and guide channel means into said ejector channel means, separator means operatively arranged relative to said magazine means and said ejector channel means, said separator means including a separator member having a tip movable for extending into and retracting the row of fasteners between a fastener stop position for holding back the row of fasteners from the ejector channel means and a fastener releasing position for releasing a fastener into the ejector channel means, said apparatus further comprising holding means so positioned relative said ejector channel means and relative to said separator means as to hold a fastener released by said separator member in said ejector channel means, and position adjusting means operatively connected to said separator member for manually adjusting the spacing of said separator member tip relative to said ejector channel means thereby to accommodate different spacings between fasteners.

2. The apparatus of claim 1, wherein said separator member has a longitudinal axis, and wherein said separator member tip is located off center relative to said longitudinal axis.

3. The apparatus of claim 1 or 2, further comprising support means, said separator member being operatively held for rotation in said support means.

4. The apparatus of claim 3, wherein said support means form a chamber for said separator member which is axially and rotatably movable in said chamber, said separator member further comprising pin means (36) extending out of said chamber, and locking groove means on said chamber for holding said pin means in different adjusted positions.

5. The apparatus of claim 1, further comprising pneumatic impact cylinder means operatively arranged for pneumatically operating said driving rod means, pneumatic separator cylinder means for pneumatically operating said separator member, and channel means operatively pneumatically coupling said impact cylinder means and said separator cylinder means so that said cylinder means are actuated in a timed alternating sequence with each other.

6. The apparatus of claim 5, wherein said channel means comprises air reservoir means for storing compressed air to effect said alternating sequence.

* * * * *

UNITED STATES PATENT OFFICE

CERTIFICATE OF CORRECTION

Patent No. 4,313,552 Dated February 2, 1982

Inventor(s) Werner Maurer

It is certified that error appears in the above-identified patent and that said Letters Patent are hereby corrected as shown below:

In Claim 1, column 4, line 65, after "retracting" insert --from--.

In Claim 1, column 5, line 2, after "relative" insert --to--.

Signed and Sealed this

*Thirteenth* Day of *April 1982*

[SEAL]

*Attest:*

GERALD J. MOSSINGHOFF

*Attesting Officer*

*Commissioner of Patents and Trademarks*